US010801798B2

(12) United States Patent
Mackey

(10) Patent No.: US 10,801,798 B2
(45) Date of Patent: Oct. 13, 2020

(54) BARREL MOUNTING SYSTEM

(71) Applicant: Super Dave Designs, LLC, Austin, TX (US)

(72) Inventor: David Charles Mackey, Round Rock, TX (US)

(73) Assignee: Super Dave Designs, LLC, Austin, TX (US)

( * ) Notice: Subject to any disclaimer, the term of this patent is extended or adjusted under 35 U.S.C. 154(b) by 0 days.

(21) Appl. No.: 16/229,637

(22) Filed: Dec. 21, 2018

(65) Prior Publication Data

US 2019/0204040 A1 Jul. 4, 2019

Related U.S. Application Data

(60) Provisional application No. 62/611,961, filed on Dec. 29, 2017.

(51) Int. Cl.
*F41A 21/48* (2006.01)

(52) U.S. Cl.
CPC ..... *F41A 21/481* (2013.01)

(58) Field of Classification Search
CPC ..... F41A 21/481
USPC ..... 42/75.02
See application file for complete search history.

(56) References Cited

U.S. PATENT DOCUMENTS

| | | | | | |
|---|---|---|---|---|---|
| 529,455 | A * | 11/1894 | Marlin | F41A 21/481 | 42/75.02 |
| 1,494,524 | A * | 5/1924 | Adamson | F41A 21/00 | 89/16 |
| 2,110,165 | A * | 3/1938 | Moore | F41A 25/22 | 42/75.02 |
| 4,920,679 | A * | 5/1990 | Sarles | F41A 21/481 | 42/75.02 |
| 6,752,061 | B2 * | 6/2004 | Knorich | F41A 21/481 | 42/75.02 |
| 2008/0168695 | A1 * | 7/2008 | Nakayama | F41A 21/481 | 42/75.02 |
| 2013/0047833 | A1 * | 2/2013 | Steimke | F41A 5/26 | 89/191.01 |
| 2015/0007478 | A1 * | 1/2015 | Barrett | F41A 21/481 | 42/75.02 |

* cited by examiner

*Primary Examiner* — Bret Hayes

(57) ABSTRACT

A barrel mounting system to mount a barrel to a barrel mount of a firearm body includes a mount receiver secured to the barrel mount. The mount receiver includes axial channels and receiver threads disposed on an interior surface. The system further includes a barrel sleeve disposed around the barrel proximal to the proximal end of the barrel. The barrel sleeve includes sleeve threads disposed near a proximal end on an exterior surface and sized to slide through the axial channels and, when rotated, to engage the receiver threads. The system further includes a barrel collar disposed around the barrel and secured to the barrel and to limit the axial position of the barrel sleeve.

19 Claims, 10 Drawing Sheets

FIG. 16
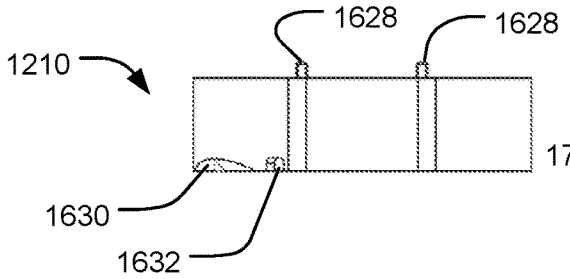
FIG. 17
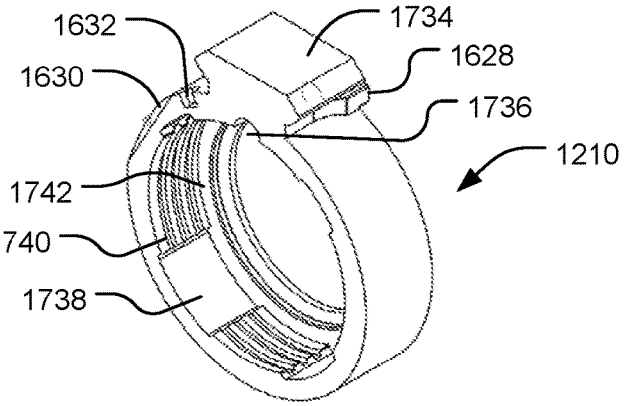
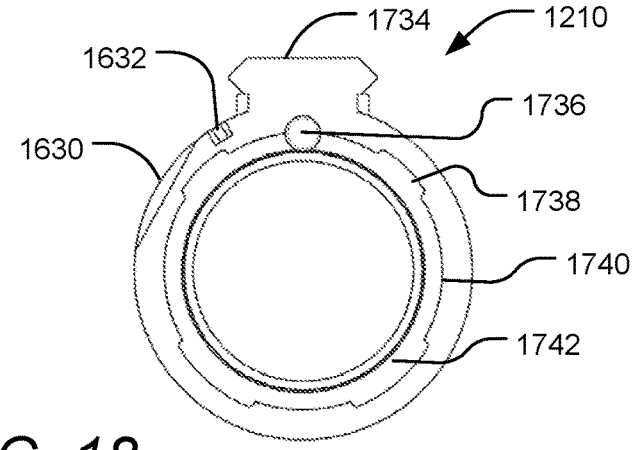
FIG. 18
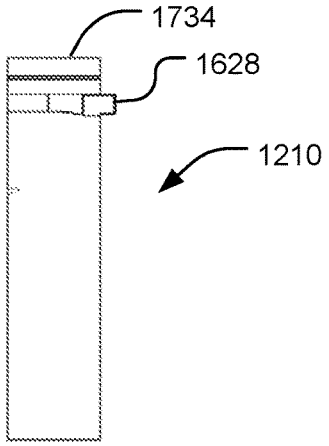
FIG. 19
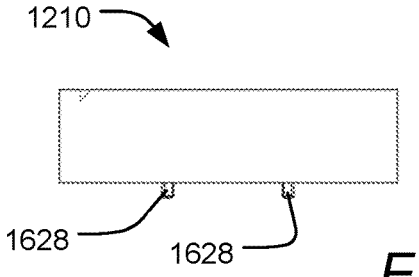
FIG. 20

FIG. 25
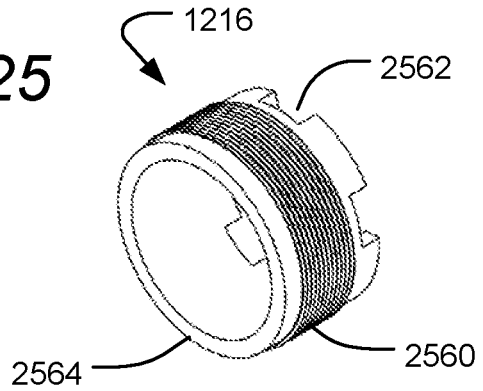
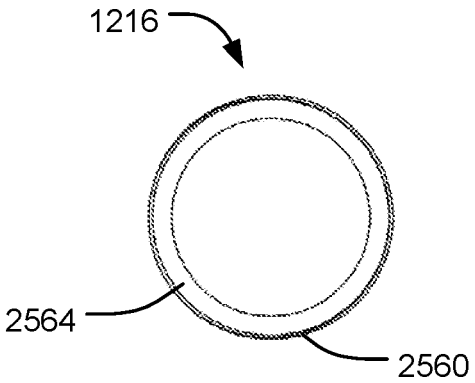
FIG. 26
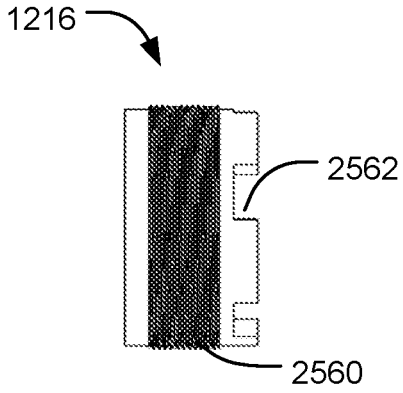
FIG. 27

BARREL MOUNTING SYSTEM

CROSS-REFERENCE TO RELATED APPLICATION(S)

This application claims benefit of U.S. Provisional Application No. 62/611,961, filed Dec. 29, 2017, which is incorporated herein by reference in its entirety.

FIELD OF THE DISCLOSURE

This disclosure, in general, relates to systems for mounting barrels to firearms and like devices.

BACKGROUND

In recent decades, there have been many armed conflicts in various regions of the world. Such armed conflicts span from cityscapes to open ranges, from heavily wooded areas to sparse unvegetated landscapes. Each of these areas, regions, or landscapes, present unique challenges to soldiers. In particular, weapons are often modified to suit the environment in which the conflict is to take place. For example, a firearm may be equipped with different accessories depending upon the expected environment. In another example, aspects of the firearm may be modified, such as the barrel length or a stock type, to suit the conditions under which the conflict is to take place.

Further, during a conflict or during training, a weapon may become damaged. For example, a barrel may overheat and warp. In another example, the barrel can be struck, causing a bend or curve. Damage to a barrel represents particular problems in that both the accuracy of the firearm is compromised and significant damage to the barrel may cause the weapon to misfire or explode.

BRIEF DESCRIPTION OF THE DRAWINGS

The present disclosure may be better understood, and its numerous features and advantages made apparent to those skilled in the art by referencing the accompanying drawings.

FIG. 16, FIG. 17, FIG. 18, FIG. 19, and FIG. 20 include illustrations of a mount receiver for use in the barrel mounting system illustrated in FIG. 12.

FIG. 25, FIG. 26, and FIG. 27 include an illustration of a barrel sleeve insert for use in the barrel mounting system illustrated in 12.

The use of the same reference symbols in different drawings indicates similar or identical items.

DETAILED DESCRIPTION

Figure 1:
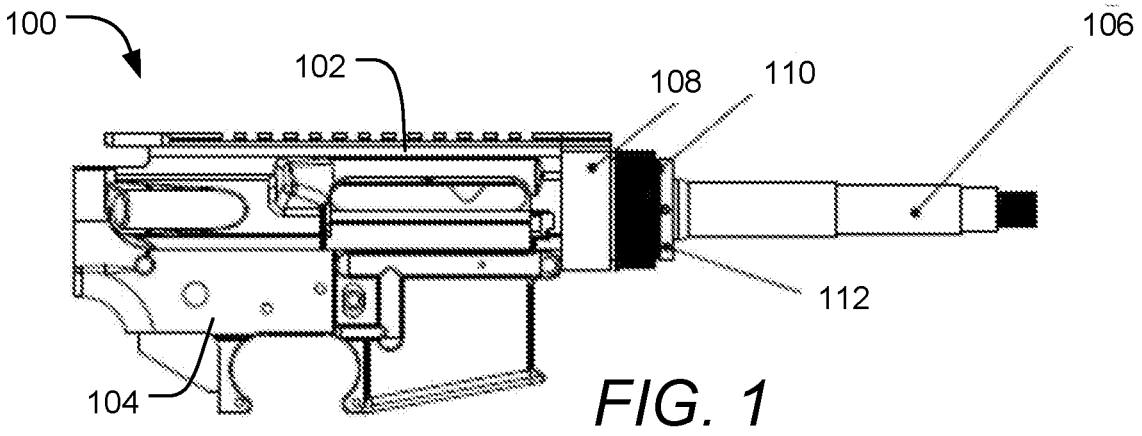
FIG. 1 illustrates a side-view of a portion of a firearm including a barrel mounting system.

FIGS. 1-32 illustrate embodiments of a barrel mounting system to mount a barrel to a body of a firearm. Embodiments of the barrel mounting system allow a user to easily and quickly install or uninstall a barrel with limited expertise. As such, a firearm can be easily disassembled for travel or to exchange a barrel for a longer barrel or a shorter barrel to adapt the firearm for use in diverse environments. In some embodiments, a barrel mounting system includes a mount receiver, a barrel sleeve having threads configured to engage threads of the mount receiver, and a barrel collar to be secured to a barrel. The mounting system can further include a mounting nut or clamp to secure the mount receiver to a body of a firearm or can include a sleeve insert to adjust a relative position of the barrel and the barrel sleeve. The mount receiver, barrel sleeve, and optionally the barrel collar can include slots or grooves positioned to receive a gas tube, piston, or rod.

A barrel mounting kit can include a mount receiver, a barrel sleeve, and barrel collar. In addition, the kit can include a mounting nut or clamp to secure the mount receiver to a body of a firearm. The kit can also include a sleeve insert to adjust a relative position of the barrel sleeve and a barrel. The mount receiver, barrel sleeve, and barrel collar can include slots or through holes to pass through a gas tube, piston, or rod. The barrel sleeve or the barrel collar can include pins or detents and the other of the barrel sleeve or barrel collar can include grooves, slots or guides to engage the pins or detents. An interior surface of the mount receiver can include a set of threads interrupted by axial channels. The threads and axial channels of the mount receiver are complementary to threads and axial channels disposed on an external surface of the barrel sleeve. The threads and axial channels of the mount receiver and the barrel sleeve can be configured to restrict the orientation that the barrel sleeve can engage the mount received relative to the firearm body or to align the barrel with the firearm body.

In use, a mount receiver is secured to a firearm body using a mounting nut or clamp Optionally, a barrel sleeve insert is supplied to a barrel sleeve and adjusted to position a barrel relative to the barrel sleeve. The barrel is inserted through the barrel sleeve. A barrel collar is applied to the barrel to lock the axially position the barrel sleeve on the barrel and restrict travel of the barrel sleeve axially. The barrel sleeve threads are inserted along axial channels of the mount receiver, and consequently the barrel is applied to a mount of the firearm body. The barrel sleeve can be rotated so that the threads of the barrel sleeve engage the threads of the mount receiver securing the barrel to the firearm body. In particular, the barrel sleeve is free to rotate around the barrel within a limited angular range while the barrel collar secures the axial position of the barrel sleeve. As such, a barrel can be mounted to and unmounted from the firearm body with the simple twist of the barrel sleeve.

Figure 2:
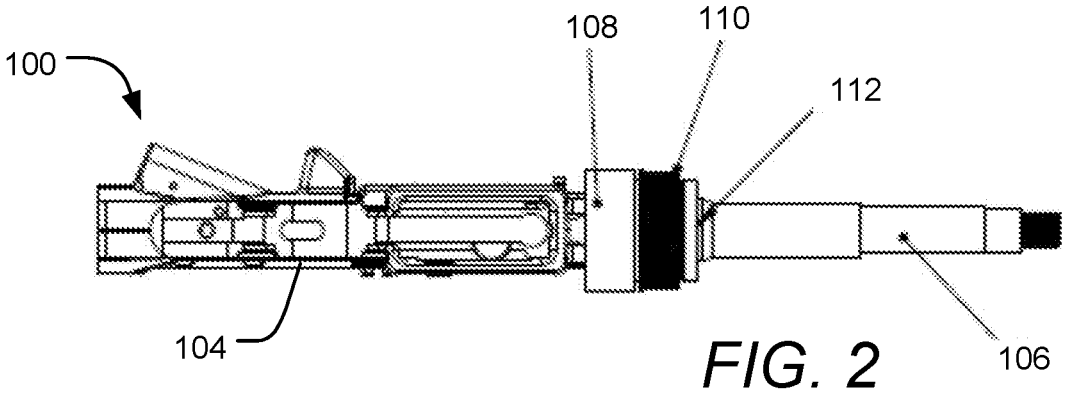
FIG. 2 illustrates a bottom-view of a portion of a firearm including a barrel mounting system.
Figure 3:
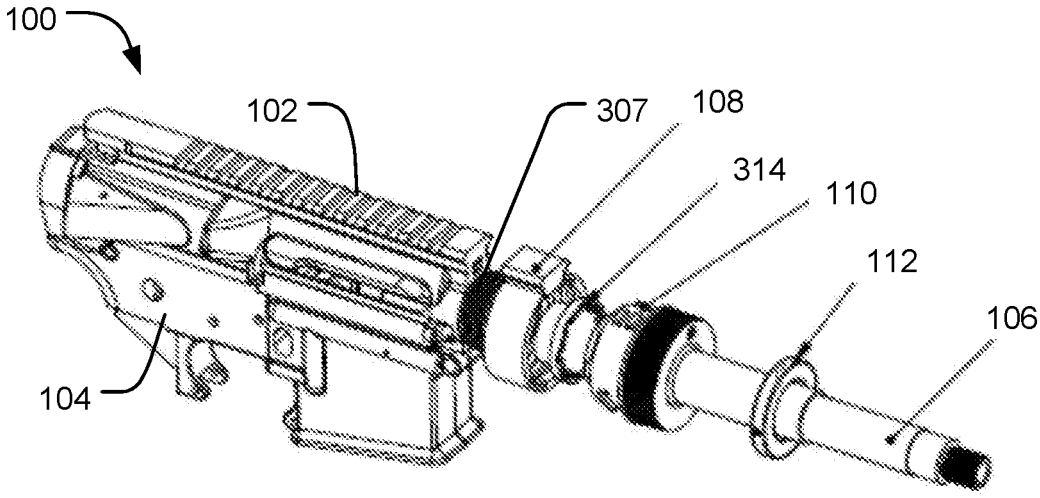
FIG. 3 illustrates a perspective-view of a portion of a firearm including a barrel mounting system.

In an embodiment illustrated in FIG. 1, FIG. 2, and FIG. 3, a firearm body 100 includes an upper portion 102 and a lower portion 104. The upper portion 102 forms a barrel mount 307 to which a barrel 106 can be attached using a barrel mount system incorporating a mount receiver 108, a barrel sleeve 110 and a barrel collar 112. The barrel mount 307 is formed as part of the upper portion 102 and can be configured with threads or with other features, such as flanges, to which a mounting nut or clamp can be attached. In the illustrated embodiment, the barrel mount 307 is threaded and a mount receiver 108 can be secured to the upper portion 102 using a mounting nut 314 screwed onto the barrel mount 307.

While the firearm body 100 is illustrated as including the upper portion 102, which attaches to a barrel 106 and includes mechanisms for ejecting a casing from a firing chamber, and as including a lower portion 104, which includes mechanisms to manage bullet loading and engage a trigger, the firearm body 100 can have various configurations, including unibody and other configurations. The upper portion 102 and the lower portion 104 can perform different functions than those illustrated.

Figure 4:
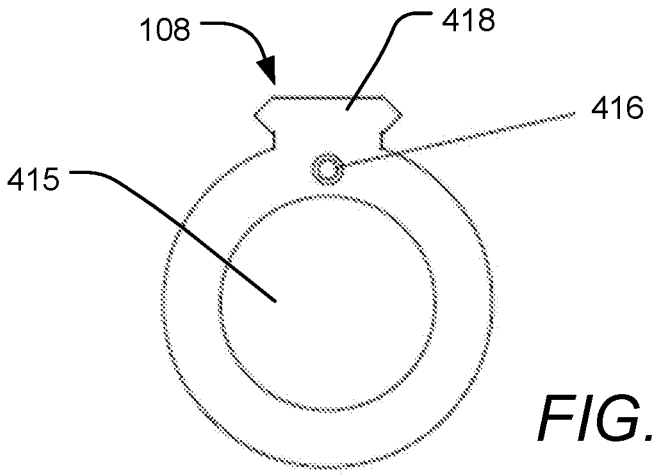
FIG. 4, FIG. 5, and FIG. 6 include illustrations of a mount receiver of the barrel mounting system of FIGS. 1, 2, and 3.
Figure 5:
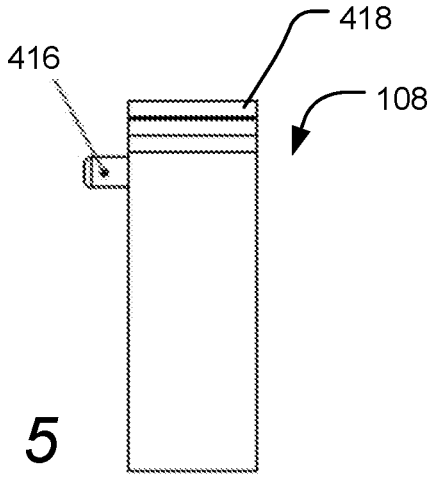
Figure 6:
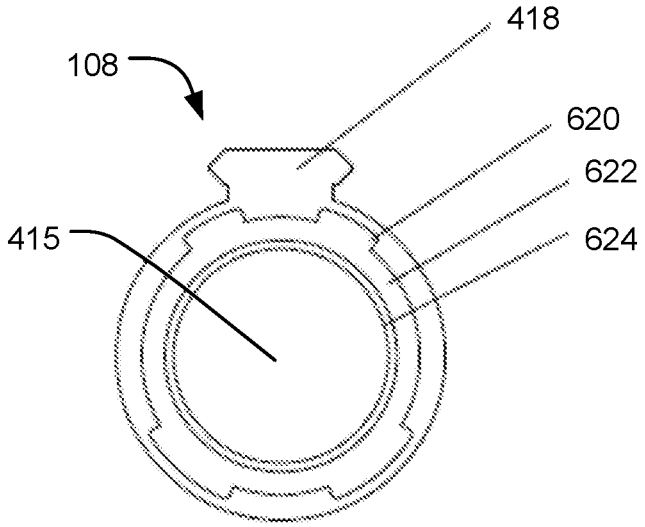

FIG. 4, FIG. 5, and FIG. 6 illustrates an embodiment of a mount receiver 108 for use in the mounting system illustrated in FIG. 1, FIG. 2, and FIG. 3. The mount receiver 108 can be secured to a barrel mount 307 of the upper portion 102 by a mounting nut or clamp 314. For example, the barrel mount 307 on the upper portion 102 of the firearm body 100 can be inserted through a hole 415 defined through the mount receiver 108. A mounting nut or clamp 314 can be secured to the barrel mount 307 of the firearm body and engage a lip or edge 624 of the mount receiver 108 to secure the mount receiver 108 to the firearm body 100.

Optionally, the mount receiver 108 can include a feature 418 to secure accessories for the firearm. For example, the feature 418 can conform to the design of the Picatinny rail or other rail system. In some embodiments, the mount receiver 108 includes a protrusion 416 that may have a central bore extending through the mount receiver 108. Such a protrusion 416 can act as a guide to position the mount receiver 108 relative to a body of a firearm. In some embodiments, a gas tube can extend through the mount receiver 108 and through the protrusion 416 and associated through hole.

The mount receiver 108 can engage a barrel sleeve 110 to securely fix a barrel 106 to the barrel mount 307. In an example, the mount receiver 108 engages the barrel sleeve 110 with a threaded connection. For example, the mount receiver 108 can include axial channels 620 and threads 622. Axial means substantially parallel to an axis of the barrel. Complementary sets of threads on the barrel sleeve 110 can be inserted along the axial channels 620 of the mount receiver 108. The barrel sleeve 110 can be twisted so that threads of the barrel sleeve 110 engaged the threads 622 of the mount receiver 108. In some embodiments, the threading on the mount receiver 108 is interior threading facing inwardly towards a central axis of the barrel 106. In another example, the threading can be external threading facing away from the central axis.

Each set of threads 622 can include between 2 and 12 threads, such as between 3 and 4 threads. The axial channels 620 between sets of threads 622 can be offset from one another by different angles. For example, the mount receiver 108 can have between 2 and 15 channels, such as between 4 and 6 channels. When moving circumferentially, a first channel can be offset from a second channel by an angle different from the offset between the second channel and a third channel. In a particular example, the mount receiver 108 has four channels. When viewing the distal face of the mount receiver 108 illustrated in FIG. 6, a top channel is offset from a bottom channel by an amount different than the offset between two top channels or an amount different than the offset between two bottom channels. Further, one side (left or right) can mirror the other side. In an additional example, the top channels can have a different size than the bottom channels. Such features can limit the number of orientations that the barrel sleeve 110 can fit the mount receiver 108. The configuration of the channels and the threads of the mount receiver 108 can limit the rotation of the barrel sleeve 110.

Figure 7:
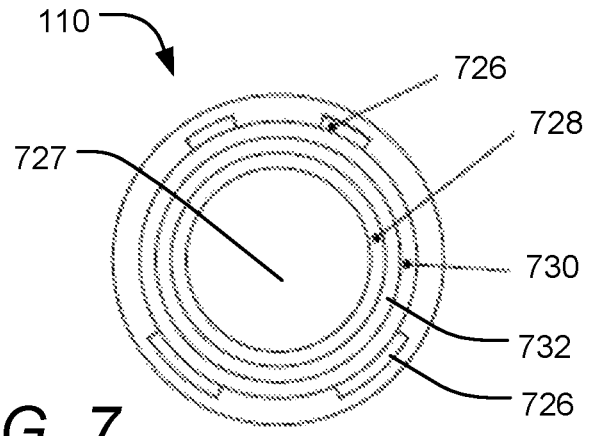
FIG. 7, FIG. 8, and FIG. 9 include illustrations of a barrel sleeve of the barrel mounting system of FIGS. 1, 2, and 3.
Figure 8:
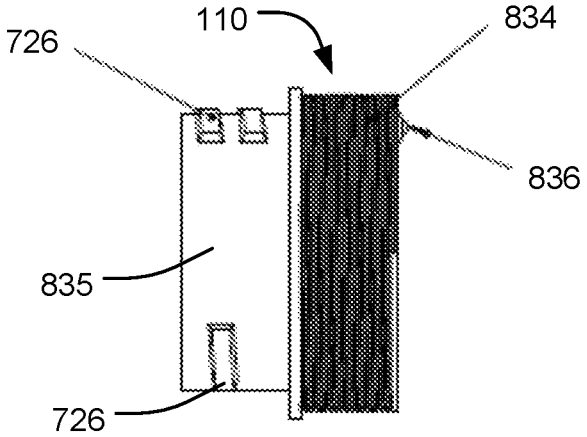
Figure 9:
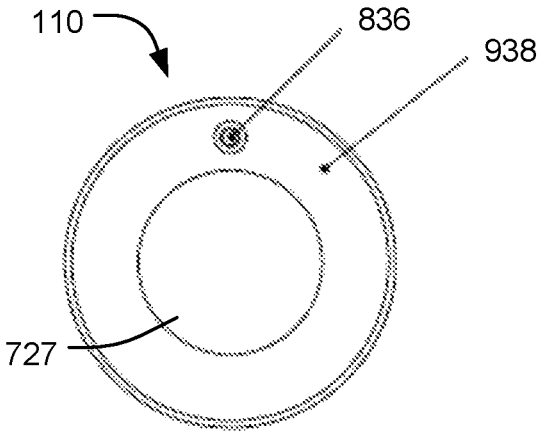

FIG. 7, FIG. 8, and FIG. 9 illustrate an embodiment of a barrel sleeve 110 for use in the barrel mounting system illustrated in FIG. 1, FIG. 2, and FIG. 3. FIG. 7 illustrates a proximal end of the barrel sleeve 110 nearest the body 100. FIG. 9 illustrates the distal facing end of the barrel sleeve 110 facing the distal end of the barrel 106. The barrel sleeve 110 includes a central bore 727 through which a barrel can extend. In some embodiments, the barrel sleeve 110 includes threads 726 separated by axial channels 835 configured to engage the mount receiver 108. In the illustrated example, the threads 726 are on an external outward facing surface of a cylinder portion 730 of the barrel sleeve 110. The sets of threads 726 are configured to engage or slide through the axial channels 620 of the mount receiver 108 and engage threads 622 of the mount receiver 108 upon of twisting the barrel sleeve 110 around the axis of the barrel 106.

In a particular example, the different sets of threads 726 can be configured, such as having different lengths, so that they fit with the mount receiver 108 in one specific orientation. For example, some sets of threads may be longer or shorter than other sets of threads so that the barrel sleeve 110 fits with the axial channels of the mount receiver 108 in a single orientation. For example, a longer set of bottom threads can be configured to fit the bottom axial channels of the mount receiver 108 and may not fit the top axial channels of the mount receiver 108. The sets of threads 726 can have between 2 and 12 threads, such as between 2 and 6 threads, for example, between 3 and 4 threads. Further, the angles between sets of threads can match those angles between the axial channels of the mount receiver 108.

The mount receiver 108 can include a physical stop to prevent over rotation of the barrel sleeve 110 when inserted and twisted in the mount receiver 108. Alternatively or in addition, the barrel sleeve 110 can include a physical stop that limits rotation of the barrel sleeve 110 when inserted into the mount receiver 108.

As illustrated in FIG. 8, the barrel sleeve 110 can further include an exterior threading 834. Such threading 834 can be used to apply a hand guard or rail mounting system around the barrel.

The barrel sleeve 110 can further include a ledge or surface 732 to engage a flange or widening of the barrel 106. Optionally, the barrel sleeve 110 can include internal threading 728 to engage a sleeve insert. The axial position can be adjusted to provide different compression force when the barrel and barrel sleeve are mounted to the firearm.

The barrel sleeve 110 can include a distal facing surface 938 that faces toward a distal end of the barrel 106 and engages the surface of the barrel collar 112. The barrel sleeve 110 at the distal end can further include one or more pins or detents 836 to engage slots or guides formed into a barrel collar 112.

Figure 10:
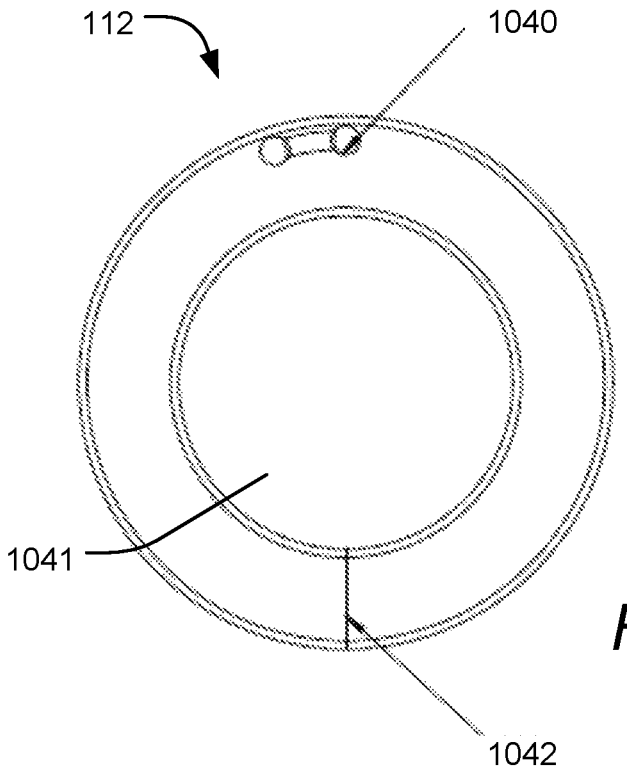
FIG. 10 and FIG. 11 include illustrations of a barrel collar of the barrel mounting system of FIGS. 1, 2, and 3.
Figure 11:
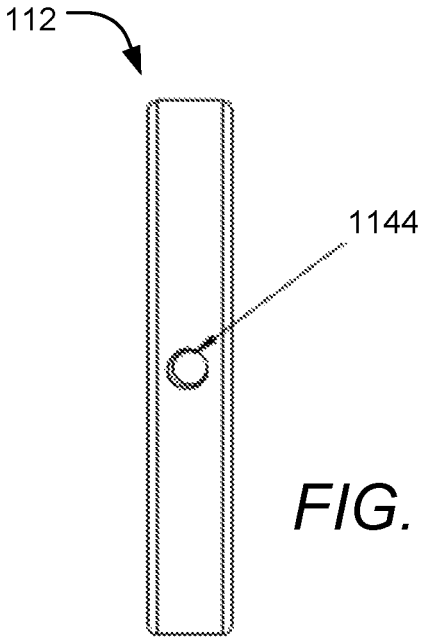

FIG. 10 and FIG. 11 illustrate of an embodiment of a barrel collar 112. The barrel collar 112 includes a central hole 1041 to engage the barrel 106 of the firearm. On the proximal facing surface directed toward the firearm body 100, as illustrated in FIG. 10, the barrel collar 112 can include slots or guides 1040 to engage the pins or detents 836 of the distal facing surface 938 of the barrel sleeve 110. Alternatively, the barrel collar 112 can include the pins or detents, and the barrel sleeve can include slots or guides. Optionally, the slot or guide is deeper on the ends and shallower in the middle to signal when the detent is engaged with the ends of the slot. As such, a user can feel when the rotation has reached a limit and the barrel sleeve 110 can lock in place when the pin or detent hits the extremes of the slot or guide. In particular, the engagement of the pins or detents with the slots or guides holds the barrel sleeve in position indexed to the barrel, such as indexed to an indexing pin of the barrel.

The barrel collar 112 is secured to a barrel 106, for example, using a set screw applied through a set screw hole 1144. While a single set screw hole is depicted, more than one set screw holes can be formed in the barrel collar 112. In an alternative example, the barrel collar can be crimped or pressure fit to the barrel 106. For example, a region 1042 can permit crimping or travel of the barrel collar 112 in a radial direction.

Returning to FIG. 1, FIG. 2, and FIG. 3, in some embodiments, the mount receiver 108 is secured to the barrel mount 307 using a mounting nut 314. The barrel sleeve 110 is mounted on the barrel. Axial travel of the barrel sleeve on an end of the barrel proximal to the firearm body is limited by a flange or size change in the barrel 106. Axial travel of the barrel sleeve 110 is limited in the distal direction of the barrel 116 by a barrel collar 112 secured to the barrel 106 using set screws. The barrel sleeve 110 maintains the ability to rotate, while the barrel mounting receiver 108 has a fixed position relative to the firearm body 100 and the barrel collar 112 has a fixed position relative to the barrel 106. As such, the barrel sleeve 110 can be inserted into and engage the mount receiver 108 with a simple twist of the barrel sleeve 110 around the axis of the barrel 106. The barrel 106 can then be separated from the firearm body 100 with a twist of the barrel sleeve 110.

Figure 12:
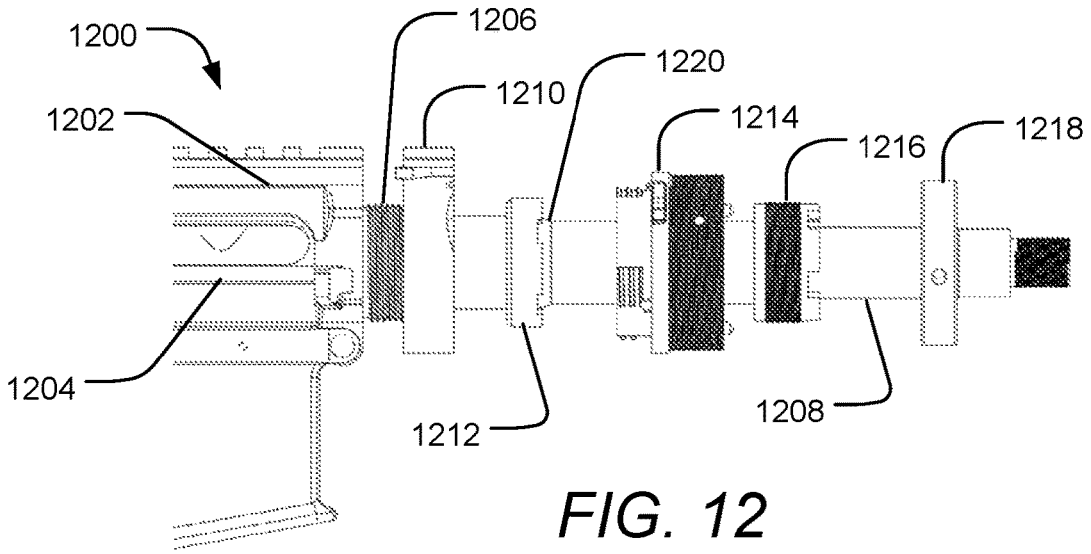
FIG. 12 includes an illustration of a portion of a firearm including a barrel mounting system.

FIG. 12 includes an illustration of an embodiment of a mounting system for mounting a barrel 1208 to a firearm body 1200. The firearm body 1200 can include an upper portion 1202 and a lower portion 1204. As illustrated, the barrel mount 1206 is formed into the upper portion 1202 of the firearm body 1200. The mount receiver 1210 can be applied over the barrel mount 1206 and can be secured to the body 1200 by applying a mounting nut 1212 to the barrel mount 1206. A barrel 1208 can be applied through a barrel sleeve 1214, which on one end proximal to the firearm body 1200 engages a flange or a change in diameter 1220 of the barrel 1208 and on opposite side distal from the firearm body 1200 engages a barrel collar 1218 that can be secured to the barrel 1208. Optionally, the mounting system includes a sleeve insert 1216, which provides the barrel sleeve 1214 with an adjustable surface to engage the change in diameter or flange 1220 of the barrel 1208.

Figure 13:
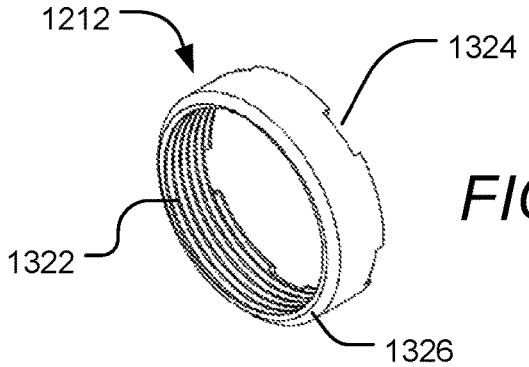
FIG. 13, FIG. 14, and FIG. 15 include an illustration of a mounting nut for use in the barrel mounting system illustrated in FIG. 12.
Figure 14:
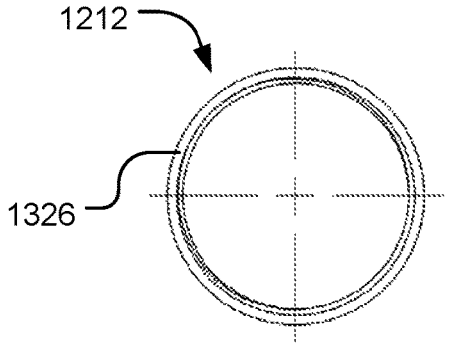
Figure 15:
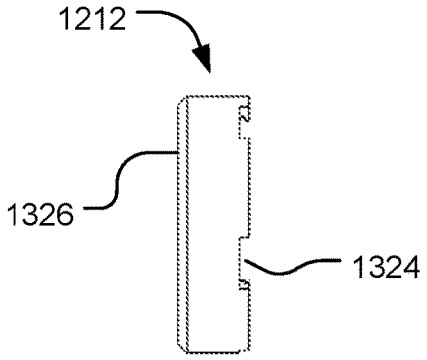
Figure 21:
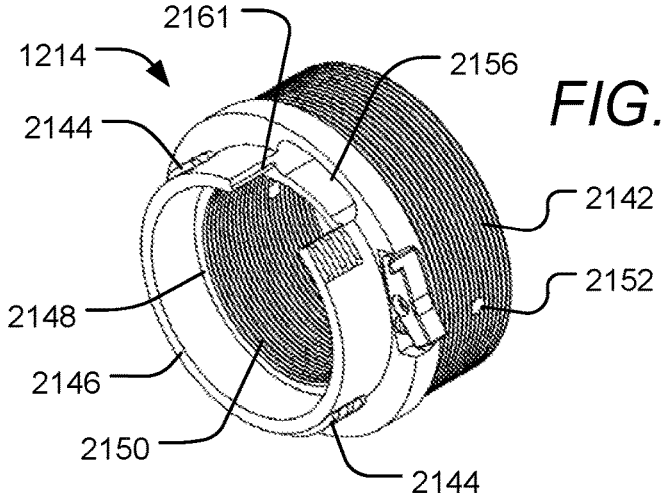
FIG. 21, FIG. 22, FIG. 23, and FIG. 24 include illustrations of a barrel sleeve for use by the barrel mounting system of FIG. 12.
Figure 22:
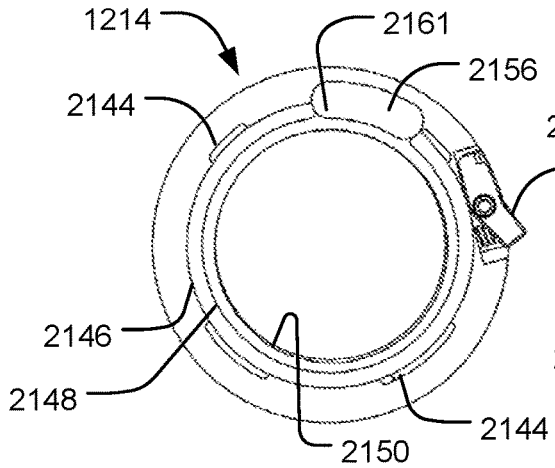

FIG. 13, FIG. 14, and FIG. 15 include illustrations of an exemplary mounting nut 1212. The mounting nut 1212 includes internal threads 1322 to engage the barrel mount 1206 of the firearm body 1200. The mounting nut 1212 further can include a beveled or contoured edge 1326 to engage an edge of the mount receiver 1210. In an example, the beveled or contoured edge 1326 can center the mount receiver 1210 to be concentric with the barrel mount 1206. Optionally, an end of the mounting nut 1212 disposed or facing away from the barrel mount 1206 or body 1200 of the firearm can be keyed using grooves or peaks and valleys 1324 to permit a tool to be used to secure the mounting nut 1212 to the barrel mount 1206.

A mount receiver 1210 is illustrated in FIG. 16, FIG. 17, FIG. 18, FIG. 19, and FIG. 20. The mount receiver 1210 includes axial channels 1738 and threads 1740 to complementarily engage threaded features of the barrel sleeve 1214. In an embodiment, the channels 1738 and optionally the threads 1740 can be figured to engage the threads of the barrel sleeve 1214 in a specific orientation.

Each set of threads 1740 can include between 2 and 12 threads, such as between 2 and 5 threads, for example, between 3 and 4 threads. The axial channels 1738 between sets of threads 1740 can be offset from one another by different angles. For example, the mount receiver 1210 can have between 2 and 15 channels, such as between 4 and 6 channels. When moving circumferentially, a first channel can be offset from a second channel by an angle different from the offset between the second channel and a third channel. In a particular example, the mount receiver 1210 has four channels. When viewing the distal face of the mount receiver 1210 illustrated in FIG. 18, a top channel is offset from a bottom channel by an amount different than the offset between two top channels or an amount different than the offset between two bottom channels. Further, one side (left or right when viewed as in FIG. 18) can mirror the other side. In an additional example, the top channels can have a different size than the bottom channels. Such features can limit the number of orientations that the barrel sleeve 1214 can fit the mount receiver 1210.

The receiver 1210 can further include an edge 1742 to engage the mounting nut 1212 to secure the mount receiver 1210 to the body 1200 of the firearm.

The mount receiver 1210 can further include a feature 1734 configured to secure accessories to a firearm. For example, the feature 1734 can conform to a Picatinny rail configuration. Further, the mount receiver 1210 can include guides 1628 to assist in positioning the mount receiver 1210 in a specific orientation. In an example, the guides 1628 align to sides of a rail system, such as a Picatinny rail system.

The mount receiver 1210 can also include a through hole 1736 to receive or allow pass-through of a gas tube, rod, or piston. The mount receiver 1210 can include a physical stop or barrier to prevent over rotation of the barrel sleeve 1214 within the mount receiver 1210. Alternatively, the physical stop or barrier can be on the barrel sleeve 1214.

Further, the mount receiver 1210 can include indentations and slots 1630 and 1632. In the example, the indentations or slots 1630 or 1632 can engage complementary features of the barrel sleeve 1214. Such complementary features can limit counter rotation and detachment of the barrel sleeve 1214 form the mount receiver 1210.

FIG. 21, FIG. 22, FIG. 23, FIG. 24, and FIG. 32 illustrate a barrel sleeve 1214. The barrel sleeve 1214 includes a cylinder portion 2146 on which are formed threads 2144 and axial channel 2359 facing exterior and away from the central axis of a barrel. The threads 2144 can be inserted into the axial channels 1738 of the mount receiver 1210 and can be sized to twist in place so that the threads 2144 of the barrel sleeve 1214 engage the threads 1740 of the mount receiver 1210. Each set of threads 2144 can include between 2 and 12 threads, such as between 2 and 6 threads, for example, between 3 and 4 threads. The angular displacement between sets of threads can match those of the axial channels of the mount receiver 1210. Further, the sets of threads can be patterned in length, angular displacement, and position to match the axial channels and threads of the mount receiver 1210.

Figure 23:
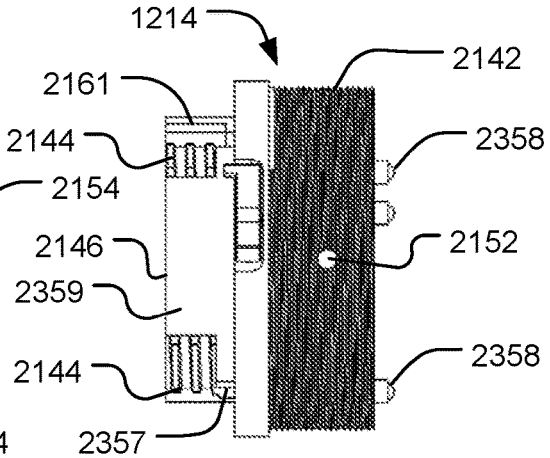
Figure 24:
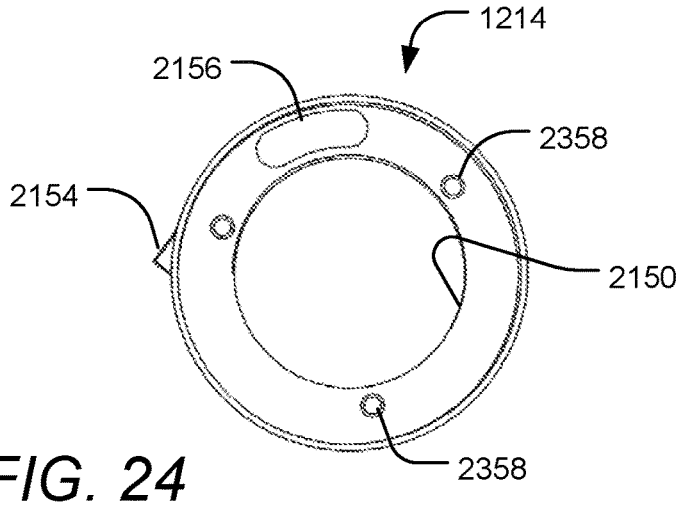
Figure 32:
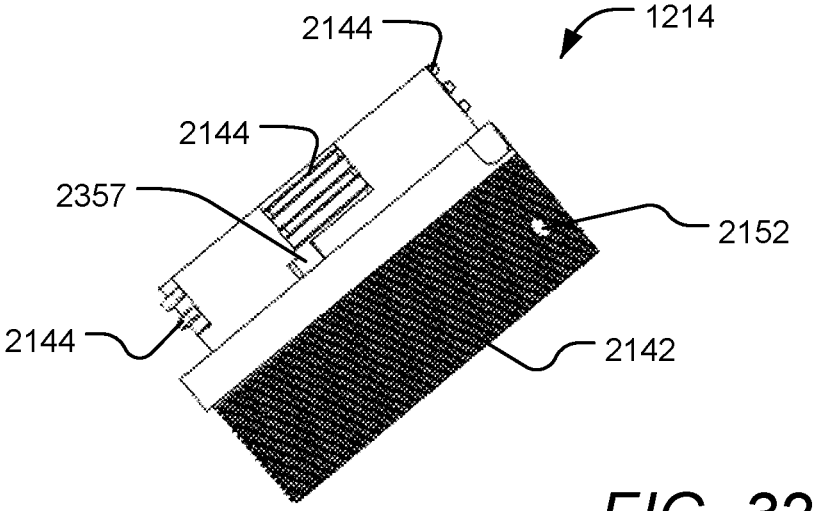
FIG. 32 includes an illustration of an example barrel sleeve for using in the barrel mounting system of FIG. 12.

In particular, engaging the mount receiver 1210 and the barrel sleeve 1214 can engage using limited rotation, for example, limited by a physical barrier. For example, the rotation can be limited to between 5° and 45°, such as between 5° and 30° or between 5° and 20°. In an example, the barrel sleeve 1214 can include a physical stop 2357 as illustrated in FIG. 23 and FIG. 32. The physical stop or barrier 2357 can hit the threads of the mount receiver 1210 to limit the rotation of the barrel sleeve as it engages the mount receiver 1210 or can hit the threads of the mount receiver 1210 as the barrel sleeve is rotated to disengage the barrel sleeve 1214 from the mount receiver 1210, preventing the threads of the barrel sleeve 1214 from re-engaging the threads of the mount receiver 1210 as a result of over rotation.

The barrel sleeve 1214 can include exterior threads 2142 to engage a handguard or rail mounting system. In an example, a handguard can include interior threads that engage the exterior threads 2142 of the barrel sleeve 1214.

The barrel sleeve 1214 can further include a slot 2156 to permit a gas tube, rod, or piston to pass through the barrel sleeve 1214. A gap 2161 in the cylinder 2146 can further allow the gas tube, rod, or piston to pass through the barrel sleeve 1214. In particular, the slot 2156 and optional gap 2161 allows the gas tube, rod, or piston to slide around the circumference of the barrel sleeve 1214 as the barrel sleeve 1214 is twisted and secured in the mount receiver 1210 or is unmounted from the mount receiver 1210.

Further, the barrel sleeve 1214 can include a locking mechanism 2154 that engages the slots and indentations 1630 or 1632 of the mount receiver 1210. In the embodiment illustrated, a lever is used to engage and disengage the features 1630 and 1632 of the mount receiver 1210. The locking mechanism 2154 when engaged with the features 1630 or 1632 of the mount receiver 1210 can further limit rotation of the barrel sleeve 1214 around the axis of the barrel 1208 and prevent the barrel sleeve 1214 from disconnecting.

Optionally, the barrel sleeve 1214 includes a ridge 2148 to engage a flange or diameter change of the barrel 1208. Alternatively, the barrel sleeve 1214 includes internal threads 2150 to receive a sleeve insert 12216 that can be used to adjust the relative position of the barrel sleeve 1214 and the barrel 1208. The sleeve insert 1216 can be secured in position using set screws 2152. The sleeve insert 1216 can be adjusted to set the compression force asserted on the barrel when engaging the firearm.

As illustrated in FIG. 25, FIG. 26, and FIG. 27, the sleeve insert 1216 can include outwardly facing threads 2560 to engage the inwardly facing threads 2150 of the barrel sleeve 1214. Further, the sleeve insert 1216 can include a surface 2564 to engage a flange or size change of the barrel 1208. Optionally, the sleeve insert 1216 can include keyed peaks and valleys 2562 to allow a key to be used to rotate the sleeve insert 1216 within the barrel sleeve 1214.

Figure 28:
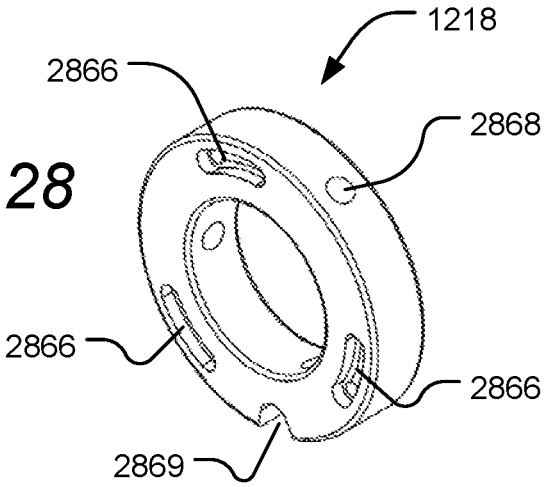
FIG. 28, FIG. 29, and FIG. 30 include illustrations of a barrel collar for use in the barrel mounting system illustrated in FIG. 12.
Figure 29:
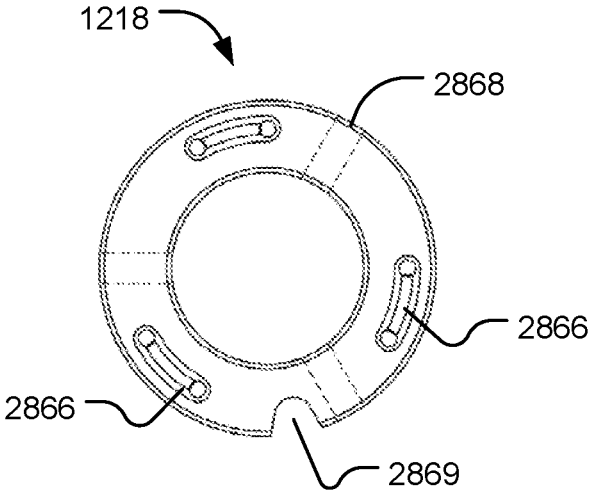
Figure 30:
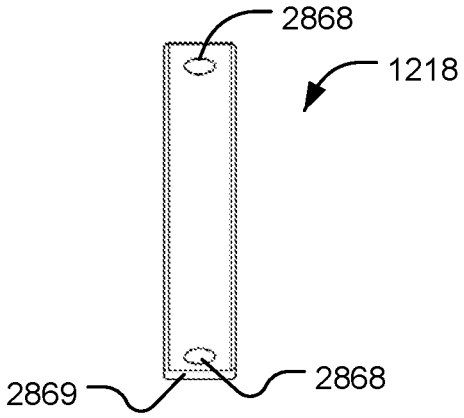

Returning to FIG. 23 and FIG. 24, the barrel sleeve 1214 can further include pins or detents 2358 disposed on a distal facing side of the barrel sleeve 1214 and to engage slots or grooves of the barrel collar 1218. FIG. 28, FIG. 29, and FIG. 30 illustrate a barrel collar 1218. The barrel collar 1218 can be inserted over a barrel and can be used to fix the position of the distal end the barrel sleeve 1214. The barrel 1208 is inserted through a central bore of the barrel collar 1218, and the barrel collar 1218 is secured to the barrel 1208 using one or more set screws 2868. In addition, the barrel collar 1218 includes grooves or slots 2866 to engage the pins or detents 2358 of the barrel sleeve 1214. Optionally, the barrel collar 1218 can include a cutout or slot 2869 that permits a gas tube, rod, or piston to pass over barrel collar 1218. The barrel collar 1218 when engaging the barrel sleeve 1214 limits rotation of the barrel sleeve 1214 so the barrel sleeve 1214 remains indexed to the barrel, allowing rapid connection and separation of the barrel from the firearm.

Figure 31:
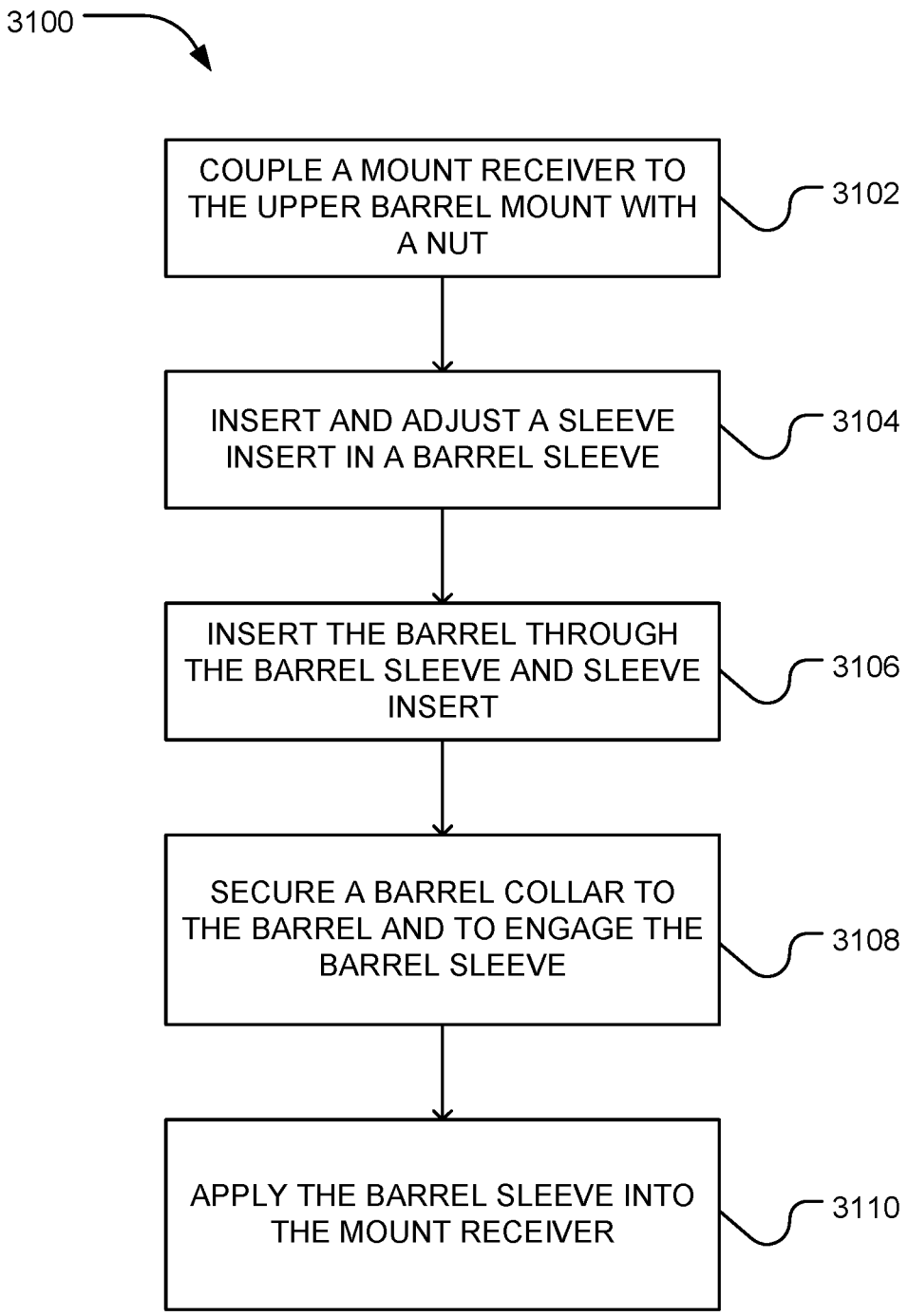
FIG. 31 is a flow diagram illustrating an exemplary method for mounting a barrel on a firearm.

In practice, a method 3100 for mounting a barrel to a firearm body, illustrated in FIG. 31, includes coupling a mount receiver to the barrel mount, for example, using a mounting nut, as illustrated at block 3102. For example, as illustrated in FIG. 12, the mount receiver 1210 is secured to the barrel mount 1206 and upper portion 1202 of the firearm body 1200 using a mounting nut 1212. Alternatively, the mount receiver 1210 can be secured to the barrel mount 1206 using a clamp device.

As illustrated at block 3104, optionally, a sleeve insert can be inserted and adjusted within a barrel sleeve. For example, the sleeve insert 1216 can be adjusted so that the barrel 1208 is positioned to properly engage the barrel mount 1206 when the barrel sleeve 1214 is inserted into the mount receiver 1210. Adjusting the sleeve insert can include using a keyed cylindrical wrench to rotate the sleeve insert 1216 in the barrel sleeve 1214 until the desired position is achieved. The relative position can adjust the compression force exhibited on the barrel when the mounting system is engaged.

The barrel is inserted through the barrel sleeve and optional sleeve insert, as illustrated at block 3106. For example, the barrel 1208 may have a flange or diameter change that engages a surface of the sleeve insert 1216, positioning the barrel sleeve 1214 relative to an end of the barrel 1208 so that when the barrel sleeve 1214 engages the mount receiver 1210, the barrel 1208 is appropriately positioned and fixed securely to the barrel mount 1206.

As illustrated at block 3108, a barrel collar 1218 can be secured to the barrel 1208, for example, using set screws and positioned against the barrel sleeve 1214. For example, pins or detents 2358 of the barrel sleeve 1214 can engage slots or grooves of the barrel collar 1218, limiting the axial position of the barrel sleeve 1214 relative to the barrel 1208, while allowing the barrel sleeve 1214 to rotate within a limited range around the barrel 1208. The barrel collar 1218 is secured to the barrel 1208 to engage the barrel sleeve 1214 in a position indexed to barrel 1208. When the pins or detents 2358 of the barrel sleeve 1214 are engaged with the slots or guides of the barrel collar 1218 and the barrel collar 1218 is positioned appropriately, the barrel sleeve 1214 remains indexed to the barrel 1208.

As illustrated at block 3110, the barrel sleeve 1214, carrying with it the barrel 1208, can be inserted into the mount receiver 1210 and rotated to secure the barrel sleeve 1214 to the mount receiver 1210. The barrel 1208 is securely fixed within an interior of the barrel mount 1206 and to the firearm body 1200. Optionally, a locking mechanism 2154 engages indentations or slots 1630 or 1632 of the mount receiver 1210 to prevent rotation of the barrel sleeve 1214.

Removing the barrel involves rotating the barrel sleeve to align the threads of the barrel sleeve with the axial channels of the mount receiver, allowing the sleeve to be separated from the mount receiver along an axial direction of the barrel 1208. When an optional locking mechanism is used, the lock can be unseated or otherwise disengaged prior to rotating the barrel sleeve relative to the mount receiver. As such, interchange of barrels, using such barrel mounting systems is relatively quick and uncomplicated.

In a first aspect, a barrel mounting system to mount a barrel to a barrel mount of a firearm body includes a mount receiver secured to the barrel mount, the mount receiver including axial channels and receiver threads disposed on an interior facing surface; a barrel sleeve disposed around the barrel proximal to the proximal end of the barrel, the barrel sleeve including sets of sleeve threads disposed near a proximal end on an exterior facing surface and sized to slide through the axial channels and, when rotated, to engage the receiver threads; and a barrel collar disposed around the barrel and secured to the barrel and to limit the axial position of the barrel sleeve.

In an example of the first aspect, the barrel mounting system further includes a mounting nut, the mounting nut securing the mount receiver to the barrel mount.

In another example of the first aspect and the above examples, the barrel mounting system further includes a sleeve insert, the barrel sleeve including internal threads to engage the sleeve insert. For example, the sleeve insert is to engage a flange or diameter change of the barrel, an axial position of the sleeve insert adjustable to adjust a relative axial position of the barrel sleeve and the barrel. In another example, the barrel sleeve further includes a set screw to secure the sleeve insert in the barrel sleeve.

In a further example of the first aspect and the above examples, the barrel sleeve includes pins or detents extending from a distal surface facing a distal end of the barrel. For example, the barrel collar includes slots or grooves to engage the pins or detents of the barrel sleeve.

In an additional example of the first aspect and the above examples, the barrel sleeve further includes a slot to permit a gas tube, rod, or piston to pass through the barrel sleeve. For example, the slot allows the barrel sleeve to rotate while the gas tube remains in a fixed position. In another example, the mount receiver includes a hole to permit the gas tube to pass through the mount receiver. In a further example, the barrel collar includes a groove to permit a gas tube to pass over the barrel collar.

In another example of the first aspect and the above examples, the barrel sleeve further comprises exterior facing threads disposed at a distal end of the barrel sleeve. For example, the exterior facing threads of the barrel sleeve are to engage a handguard.

In a further example of the first aspect and the above examples, the barrel mounting system further includes the mount receiver includes a rail feature.

In an additional example of the first aspect and the above examples, the mount receiver includes an alignment feature to align the mount receive with the firearm body.

In another example of the first aspect and the above examples, the mount receiver includes a physical stop to limit rotation of the barrel sleeve.

In a further example of the first aspect and the above examples, the barrel sleeve further includes a locking mechanism to engage a locking feature of the mount receiver to limit counter rotation of the barrel sleeve. For example, the barrel collar further includes a set screw to secure the barrel collar to the barrel.

In an additional example of the first aspect and the above examples, the barrel mounting system further includes the sets of sleeve threads include 2 to 12 threads.

In another example of the first aspect and the above examples, axial channels to receive adjacent sets of sleeve threads are offset by different angles.

In a further example of the first aspect and the above examples, adjacent sets of sleeve threads have different thread lengths.

In a second aspect, a firearm includes a firearm body defining a barrel mount; a barrel having a proximal end to engage the barrel mount and a distal end; a mount receiver secured to the barrel mount by a mounting nut, the mount receiver including axial channels and receiver threads disposed on an interior surface; a barrel sleeve disposed around the barrel proximal to the proximal end of the barrel, the barrel sleeve including sets of sleeve threads disposed near a proximal end on an exterior surface and sized to slide through the axial channels and, when rotated, to engage the receiver threads, the barrel sleeve including pins or detents extending from an axial surface facing a distal end of the barrel; and a barrel collar disposed around the barrel and secured to the barrel, the barrel collar including slots or grooves to engage the pins or detents of the barrel sleeve.

In an example of the second aspect, the barrel sleeve including internal threads to engage a sleeve insert. For example, the firearm further includes the sleeve insert disposed within the barrel sleeve and around the barrel, the sleeve insert to engage a flange or diameter change of the barrel. In another example, an axial position of the sleeve insert is adjustable to adjust a relative axial position of the barrel sleeve and the barrel. In a further example, the barrel sleeve further includes a set screw to secure the sleeve insert in the barrel sleeve.

In another example of the second aspect and the above examples, the barrel sleeve further includes a slot to permit a gas tube, rod, or piston to pass through the barrel sleeve. For example, the slot allows the barrel sleeve to rotate while the gas tube, rod, or piston remains in a fixed position. In another example, the mount receiver includes a hole to permit the gas tube, rod, or piston to pass through the mount receiver. In an additional example, the barrel collar includes a groove to permit the gas tube, rod, or piston to pass over the barrel collar.

In a further example of the second aspect and the above examples, the barrel sleeve further comprises exterior facing threads disposed at a distal end of the barrel sleeve. For example, the exterior facing threads of the barrel sleeve are to engage a handguard.

In an additional example of the second aspect and the above examples, the mount receiver includes a rail feature.

In another example of the second aspect and the above examples, the mount receiver includes an alignment feature to align the mount receive with the firearm body.

In a further example of the second aspect and the above examples, the barrel sleeve includes a physical stop to limit rotation of the barrel sleeve.

In an additional example of the second aspect and the above examples, the barrel sleeve further includes a locking mechanism to engage a feature of the mount receiver to limit counter rotation of the barrel sleeve.

In another example of the second aspect and the above examples, the barrel collar further includes a set screw to secure the barrel collar to the barrel.

In a further example of the second aspect and the above examples, the sets of sleeve threads include 2 to 12 threads.

In an additional example of the second aspect and the above examples, adjacent sets of sleeve threads are offset by different angles.

In another example of the second aspect and the above examples, adjacent sets of sleeve threads are offset by different thread lengths.

In a further example of the second aspect and the above examples, the barrel sleeve includes 4 sets of sleeve threads.

In a third aspect, a barrel mounting kit includes a mount receiver to be secured to a barrel mount of a firearm body, the mount receiver including axial channels and receiver threads disposed on an interior surface; a barrel sleeve to be disposed around a barrel proximal to a proximal end of the barrel, the barrel sleeve including sleeve threads disposed near a proximal end on an exterior surface and sized to slide through the axial channels of the mount receiver and, when rotated, to engage the receiver threads of the mount receiver; and a barrel collar to be disposed around the barrel and secured to the barrel and to limit the axial position of the barrel sleeve.

In an example of the third aspect, the barrel mounting kit further including a mounting nut, the mounting nut securing the mount receiver to the barrel mount.

In another example of the third aspect and the above examples, the barrel mounting kit further includes a sleeve insert, the barrel sleeve including internal threads to engage the sleeve insert. For example, the sleeve insert is to engage a flange or diameter change of the barrel, an axial position of the sleeve insert adjustable to adjust a relative axial position of the barrel sleeve and the barrel. In another example, the barrel sleeve further includes a set screw to secure the sleeve insert in the barrel sleeve.

In a further example of the third aspect and the above examples, the barrel sleeve includes pins or detents extending from an axial surface facing a distal end of the barrel. For example, the barrel collar includes slots or groove to engage the pins or detents of the barrel sleeve.

In an additional example of the third aspect and the above examples, the barrel sleeve further includes a slot to permit a gas tube to pass through the barrel sleeve. For example, the slot allows the barrel sleeve to rotate while the gas tube remains in a fixed position. In an example, the mount receiver includes a hole to permit the gas tube to pass through the mount receiver. In another example, the barrel collar includes a groove to permit a gas tube to pass over the barrel collar.

In a further example of the third aspect and the above examples, the barrel sleeve further comprises exterior facing threads disposed at a distal end of the barrel sleeve. For example, the exterior facing threads of the barrel sleeve are to engage a handguard.

In an additional example of the third aspect and the above examples, the mount receiver includes a rail feature.

In another example of the third aspect and the above examples, the mount receiver includes an alignment feature to align the mount receive with the firearm body.

In a further example of the third aspect and the above examples, the mount receiver includes a physical stop to limit rotation of the barrel sleeve.

In an additional example of the third aspect and the above examples, the barrel sleeve further includes a locking mechanism to engage a locking feature of the mount receiver to limit counter rotation of the barrel sleeve. For example, the barrel collar further includes a set screw to secure the barrel collar to the barrel.

In a fourth aspect, a method of mounting a barrel to a barrel mount of a firearm body includes inserting sleeve threads of a barrel sleeve through axial channels of a mount receiver, the barrel sleeve disposed around a barrel and engaging a flange or diameter change of the barrel, a barrel collar secured to the barrel and limiting an axial position of the barrel sleeve relative to the barrel; and rotating the barrel sleeve around an axis of the barrel, the sleeve threads of the barrel sleeve engaging receiver threads of the mount receiver, the barrel fixed to the barrel mount.

In an example of the fourth aspect, the method further includes securing the mount receiver to the barrel mount using a mounting nut.

In another example of the fourth aspect and the above examples, the method further includes securing the barrel collar to the barrel using a set screw.

In a further example of the fourth aspect and the above examples, the method further includes inserting a sleeve insert into the barrel sleeve; and adjusting a position of the sleeve insert within the barrel sleeve.

In an additional example of the fourth aspect and the above examples, the method further includes applying a gas tube through a slot of the barrel sleeve and a hole of the mount receiver.

In a fifth aspect, a barrel sleeve includes a cylindrical portion defining an axial hole to receive a barrel; sets of threads disposed on an exterior of the cylindrical portion at a first axial end, the sets of threads distributed around the circumference of the cylindrical portion; and pins or detents disposed on a face at a second axal end.

In another example of the fifth aspect and the above examples, the barrel sleeve further includes interior threads disposed interior to the cylindrical portion proximal to the second axial.

In a further example of the fifth aspect and the above examples, the barrel sleeve further includes exterior threads disposed on an exterior surface of the cylindrical portion proximal to the second axial end.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A barrel mounting system to mount a barrel to a barrel mount of a firearm body, the barrel mounting system comprising:

a mount receiver secured to a barrel mount, the mount receiver including axial channels and receiver threads disposed on an interior facing surface;

a barrel sleeve disposed around a barrel proximal to a proximal end of the barrel, the barrel sleeve including sets of sleeve threads disposed near a proximal end on an exterior facing surface and sized to slide through the axial channels and, when rotated, to engage the receiver threads;

a sleeve insert, the barrel sleeve including internal threads to engage the sleeve insert; and a barrel collar disposed around the barrel and secured to the barrel and to limit an axial position of the barrel sleeve.

2. The barrel mounting system of claim 1, further comprising a mounting nut, the mounting nut securing the mount receiver to the barrel mount.

3. The barrel mounting system of claim 1, wherein the sleeve insert is to engage a flange or diameter change of the barrel, an axial position of the sleeve insert adjustable to adjust a relative axial position of the barrel sleeve and the barrel.

4. The barrel mounting system of claim 1, wherein the barrel sleeve further includes a set screw to secure the sleeve insert in the barrel sleeve.

5. The barrel mounting system of claim 1, wherein the barrel sleeve includes pins or detents extending from a distal surface facing a distal end of the barrel.

6. The barrel mounting system of claim 5, wherein the barrel collar includes slots or grooves to engage the pins or detents of the barrel sleeve.

7. The barrel mounting system of claim 1, wherein the barrel sleeve further includes a slot to permit a gas tube, rod, or piston to pass through the barrel sleeve.

8. The barrel mounting system of claim 7, wherein the slot allows the barrel sleeve to rotate while the gas tube, rod, or piston remains in a fixed position.

9. The barrel mounting system of claim 7, wherein the mount receiver includes a hole to permit the gas tube to pass through the mount receiver.

10. The barrel mounting system of claim 7, wherein the barrel collar includes a groove to permit a gas tube to pass over the barrel collar.

11. The barrel mounting system of claim 1, wherein the barrel sleeve further comprises exterior facing threads disposed at a distal end of the barrel sleeve.

12. The barrel mounting system of claim 11, wherein the exterior facing threads of the barrel sleeve are to engage a handguard.

13. The barrel mounting system of claim 1, wherein the mount receiver includes a rail feature.

14. The barrel mounting system of claim 1, wherein the mount receiver includes an alignment feature to align the mount receiver with a firearm body.

15. The barrel mounting system of claim 1, wherein the mount receiver includes a physical stop to limit rotation of the barrel sleeve.

16. The barrel mounting system of claim 1, wherein the barrel sleeve further includes a locking mechanism to engage a locking feature of the mount receiver to limit counter rotation of the barrel sleeve.

17. The barrel mounting system of claim 16, wherein the barrel collar further includes a set screw to secure the barrel collar to the barrel.

18. The barrel mounting system of claim 1, wherein the sets of sleeve threads include 2 to 12 threads.

19. The barrel mounting system of claim 1, wherein axial channels to receive adjacent sets of sleeve threads are offset by different angles.

* * * * *